United States Patent [19]

Levefelt

[11] Patent Number: 4,621,870

[45] Date of Patent: Nov. 11, 1986

[54] SUPPORT FOR A CUTTING TOOL FOR CUTTING HARD MATERIAL

[75] Inventor: Bert G. Levefelt, Mariestad, Sweden

[73] Assignee: Santrade Limited, Lucerne, Switzerland

[21] Appl. No.: 731,879

[22] Filed: May 8, 1985

[30] Foreign Application Priority Data

May 21, 1984 [SE] Sweden ..... 8402716

[51] Int. Cl.[4] ..... E21C 35/18

[52] U.S. Cl. ..... 299/91; 299/93

[58] Field of Search ..... 299/91, 92, 93

[56] References Cited

U.S. PATENT DOCUMENTS

| | | | |
|---|---|---|---|
| 1,595,112 | 8/1926 | Mentzer | 299/91 |
| 2,118,872 | 5/1938 | Weimer | 299/91 |
| 3,336,081 | 8/1967 | Ericsson | 299/91 |
| 4,057,294 | 11/1977 | Krekeler | 299/93 |
| 4,275,929 | 6/1981 | Krekeler | 299/91 |
| 4,542,943 | 9/1985 | Montgomery, Jr. | 299/91 X |

FOREIGN PATENT DOCUMENTS

| | | | |
|---|---|---|---|
| 1433234 | 10/1968 | Fed. Rep. of Germany | 299/91 |
| 1468477 | 2/1967 | France | 299/91 |
| 2032495 | 5/1980 | United Kingdom | 299/91 |

*Primary Examiner*—Stephen J. Novosad
*Assistant Examiner*—Michael A. Goodwin
*Attorney, Agent, or Firm*—Burns, Doane, Swecker & Mathis

[57] ABSTRACT

A support for a cutting tool for cutting hard material comprises a machine-oriented member and a tool-oriented member. A projecting portion on the machine-oriented member is adapted to be received in a recess in the tool-oriented member. The two members are adapted to be secured to each other by wedge action between cooperating wedge surfaces on the projecting portion and in the recess.

10 Claims, 6 Drawing Figures

SUPPORT FOR A CUTTING TOOL FOR CUTTING HARD MATERIAL

BACKGROUND AND OBJECTS OF THE INVENTION

The present invention relates to a support for a cutting tool for cutting hard material, such as coal or asphalt, comprising a first member adapted to be permanently secured to an earth excavating machine and a second member releasably secured to the first member and adapted to carry the cutting tool in a tool seat.

Supports of this type are described in for instance No. EP-A-25421, No. GB-A-2077810 and U.S. Pat. No. 4,337,980.

The object of the invention is to provide a support in which the overall height of the support is as small as possible, i.e. in which the tool is carried as close as possible to the machine.

Another object of the invention is to provide a support in which the tool holder is readily exchangeable while at the same time ensuring that the tool holder, in use, is secured to the machine-oriented member in a reliable manner.

DESCRIPTION OF THE DRAWINGS

The invention is described in detail in the following description with reference to the accompanying drawings in which two embodiments are shown by way of example. It is to be understood that these embodiments are only illustrative of the invention and that various modifications thereof may be made within the scope of the claims.

In the drawings.

DETAILED DESCRIPTION OF A PREFERRED EMBODIMENT OF THE INVENTION

Figure 1:
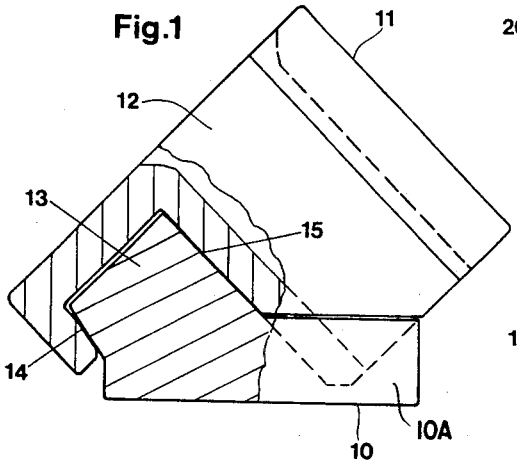
FIG. 1 shows a side view, partly in section, of a support according to the invention.
Figure 2:
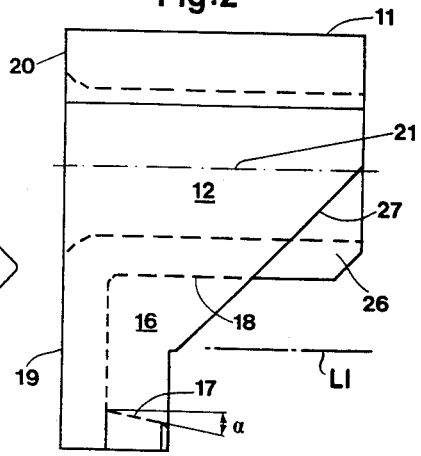
FIG. 2 shows a side view of the tool holder forming part of the support in FIG. 1.
Figure 3:
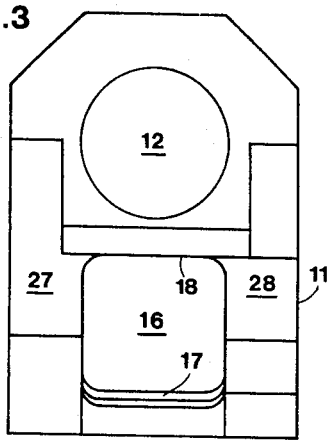
FIG. 3 shows a rear view of the tool holder in FIG. 2.
Figure 4:
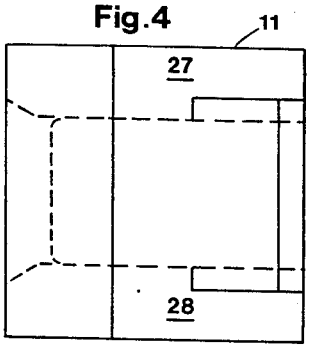
FIG. 4 shows a bottom view of the tool holder in FIG. 2.
Figure 5:
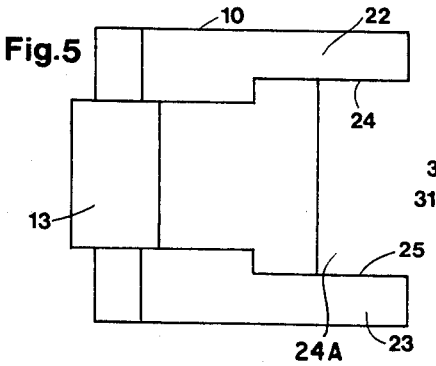
FIG. 5 shows a top view of the machine-oriented member forming part of the support in FIG. 1.

In the drawings, the support comprises a machine-oriented base member 10, which includes a mounting section 10A adapted to be permanently secured, preferably by welding, to an earth excavating machine, not shown, for instance a road planing machine of the type disclosed in No. EP-A-25421 or a coal mining machine. A tool-oriented member or tool holder 11 is releasably secured to the member 10. The tool holder 11 is provided with a tool seat or recess in form of a bore 12, in which a cutting tool for cutting hard material, such as coal and asphalt, is intended to be mounted. The cutting tool can be either rotatably or non-rotatably carried in the bore 12.

In use, the tool holder 11 is subjected to mechanical damages. Therefore, it is desired that a damaged tool holder can be replaced by a new one in a simple and quick manner. According to the invention the machine-oriented member 10 is provided with a projecting portion 13, which has outwardly converging supporting surfaces 14,15. The supporting surface 15 is generally located between the supporting surface 14 and the bore 12. The tool holder 11 is provided with a socket-type recess 16, which is adapted to receive the projecting portion 13. Therefore, the recess 16 has converging supporting surfaces 17,18 which are adapted to cooperate with the supporting surfaces 14,15. The supporting surfaces 14,15 and 17,18, respectively, form an included angle a between 3° and 20°. The recess 16 includess a longitudinal axis L1 disposed parallel to the axis 21 of the recess 12. The recesses 12, 16 are situated side-by-side, being spaced apart in a direction laterally of a longitudinal axis defined by the recess 16. The longitudinal length of the recess 12 is greater than that of the recess 16, the latter having forward and rearward ends which terminate short of the forward and rearward ends of the recess 12.

The recess 16 is in its underneath side provided with a tongue 19, which projects from the main body 20 of the tool holder 11. The supporting surface 18 nearest to the main body 20 is substantially parallel to the longitudinal axis of the cutting tool, i.e. the centre line 21 of the bore 12, and the included angle $\alpha$ is 10°.

Rearwards, the machine-oriented member 10 is provided with two side portions 22,23 having opposed side surfaces 24,25 which define a slot 24A therebetween. The rear, lower portion 26 of the tool holder 11 is narrower than the remainder of the main body 20 and is adapted to be received in the slot 24A between the side portions 22,23. The tool holder 11 has bottom surfaces 27,28 on both sides of the portion 26, said bottom surfaces being substantially parallel to the top side of the machine-oriented member 10. The tool holder 11 and the member 10, then, are mutually dimensioned such that there is provided a clearance along adjacent surfaces large enough to ensure a wedge connection at the supporting surfaces 14,15,17,18. This means that the distance between the side surfaces 24, 25 of the side portions 22,23 shall be slightly larger than the width of the portion 26 of the holder. Further, when the tool holder 11 is mounted on the member 10, a clearance shall exist between the top side of the member 10 and the bottom surfaces 27,28.

Figure 6:
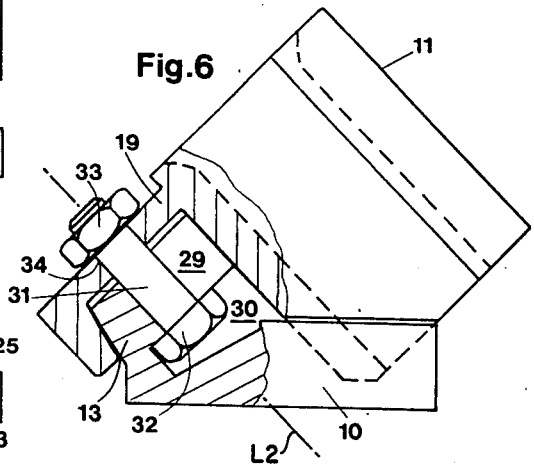
FIG. 6 shows a side view, partly in section, of an alternative embodiment of a support according to the invention.

In the alternative embodiment shown in FIG. 6 the tool holder 11 is secured to the machine-oriented member 10 by means of a bolt connection. The projecting portion 13, then, is provided with a laterally opening slit 29 and an enlargement 30 in connection thereto, which receive a bolt 31 and the head 32 thereof. The slit 29 opens laterally of a longitudinal axis L2 defined by the projection 13. The bolt 31 traverses through a bore 34 in the tongue 19 and a clamping nut 33 rests against the top side of the tongue 19. When needed, also the tool holder 11 in the embodiment according to FIGS. 1-5 can be rigidly secured to the member 10, for instance by means of some spot welds at the rear edge of the bottom surfaces 27, 28. These spot welds can easily be cut off by means of a grinding machine.

In the two embodiments illustrated by way of example the supporting surfaces 14, 17 or 15, 18 are planar. For purposes of preventing the tool holder 11 from moving sidewards relative to the member 10, however, these surfaces might be suitably shaped, for instance broken having an inclined angle of say 150°. Further, the supporting surfaces 14, 15 can be arbitrarily directed provided that they between themselves form a suitable included angle.

In the illustrated embodiments the converging surfaces providing the wedge connection between the members 10, 11 are provided by the supporting surfaces 14, 15. However, it is believed to be possible to instead form the other two mutually opposed surfaces on the projecting portion 13 as converging, i.e. the surfaces parallel to the side surfaces 24, 25. In that case, suitably, the surfaces 14, 15 would be mutually parallel.

I claim:

1. A tool support apparatus for a cutting tool of the type for cutting hard material such as coal and asphalt, said support apparatus comprising:

a base including a mounting section adapted for securement to a cutting machine, said mounting section carrying a projection which includes first surface means converging in a forward direction away from said mounting section, a slit formed in said projection, said slit opening laterally of a first longitudinal axis defined by said projection and also opening forwardly through said projection, a tool holder including first and second side-by-side recesses, said first recess adapted to removably receive said tool, said second recess adapted to removably receive said projection, said first and second recesses being spaced apart in a direction which is lateral relative to a second longitudinal axis defined by said second recess, said second recess comprising a socket open at one longitudinal end thereof and including a tongue overlying an opposing longitudinal end thereof, said tongue including a through-hole extending completely through said tongue in a direction generally parallel to said second longitudinal axis, said socket including second surface means converging in a direction away from said open end thereof and arranged to wedgingly engage said first surface means of said projection, and a fastener sized to be laterally inserted into said projection through said slit and to extend forwardly along said firsrt and second axes and through said through-hole for removably securing said projection within said socket.

2. A tool support apparatus according to claim 1, wherein said first recess extends completely through said holder so as to be open at both longitudinal ends.

3. A tool support apparatus according to claim 1, wherein said fastener comprises a threaded bolt including a threaded end projecting through said through-hole, and a nut threadably fastenable to said threaded end.

4. A tool support apparatus according to claim 1, wherein said first recess has a longitudinal length which is longer than that of said second recess.

5. A tool support apparatus according to claim 4, wherein front and rear ends of said second recess terminate short of front and rear ends, respectively, of said first recess.

6. A tool support apparatus according to claim 1, wherein said base includes a slot into which extends a rear portion of said holder such that portions of said base straddle said rear portion.

7. A tool support apparatus according to claim 1, wherein said first and second converging surface means each define an included angle between 3° and 20°.

8. A tool holder adapted to carry a tool of the type for cutting hard material such as coal and asphalt and to be secured to a wedge projection, said tool holder including first and second side-by-side recesses, said second recess adapted to removably receive said projection, said first and second recesses being spaced apart in a direction which is lateral relative to a longitudinal axis defined by said second recess, said second recess comprising a socket open at one longitudinal end thereof and including a tongue overlying an opposite longitudinal end of said socket, said tongue including a through-hole extending completely through said tongue in a direction aligned with said longitudinal axis, said through-hole arranged to receive a fastener extending from said projection, said socket including surface means converging in a direction away from said open end thereof and arranged to wedgingly engage said wedge projection.

9. A tool holder according to claim 8, wherein said first recess extends completely through said holder so as to be open at both longitudinal ends.

10. A tool holder according to claim 9, wherein the longitudinal length of said first recess is greater than that of said secondd recess.

* * * * *